US008360414B2

(12) United States Patent
Lo et al.

(10) Patent No.: US 8,360,414 B2
(45) Date of Patent: Jan. 29, 2013

(54) IMAGING DEVICE

(75) Inventors: Kevin Lo, Vancouver, WA (US); Neil Hall, Vancouver, WA (US); Allan G. Olson, Vancouver, WA (US); Wes Schalk, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1195 days.

(21) Appl. No.: 11/974,844

(22) Filed: Oct. 15, 2007

(65) Prior Publication Data

US 2009/0096152 A1 Apr. 16, 2009

(51) Int. Cl.
*B65H 3/06* (2006.01)
*B65H 5/00* (2006.01)

(52) U.S. Cl. ..... 271/109; 271/264

(58) Field of Classification Search ..... 271/264, 271/110, 147, 109
See application file for complete search history.

(56) References Cited

U.S. PATENT DOCUMENTS

| | | | | |
|---|---|---|---|---|
| 5,785,311 | A * | 7/1998 | Doery | 271/110 |
| 5,848,786 | A * | 12/1998 | Holland-Letz et al. | 271/110 |
| 5,882,004 | A | 3/1999 | Padget | |
| 5,938,189 | A * | 8/1999 | Holland-Letz et al. | 271/152 |
| 6,042,103 | A | 3/2000 | Yraceburu | |
| 2005/0285328 | A1 | 12/2005 | Rumford | |
| 2006/0157911 | A1 | 7/2006 | Learmonth | |
| 2007/0140772 | A1 | 6/2007 | Barinaga | |

FOREIGN PATENT DOCUMENTS

DE 4124566 C * 7/1992

* cited by examiner

*Primary Examiner* — Patrick Cicchino

(57) ABSTRACT

An imaging device including a pivoting media pick tire is described.

13 Claims, 1 Drawing Sheet

IMAGING DEVICE

BACKGROUND

Imaging devices may include pick devices for picking a sheet of print media from a print media support. It may be desirable to reduce mispicks of a single sheet and to reduce simultaneous multi-picks of several sheets.

DETAILED DESCRIPTION OF THE DRAWINGS

Figures 1, 2, 3, 4:
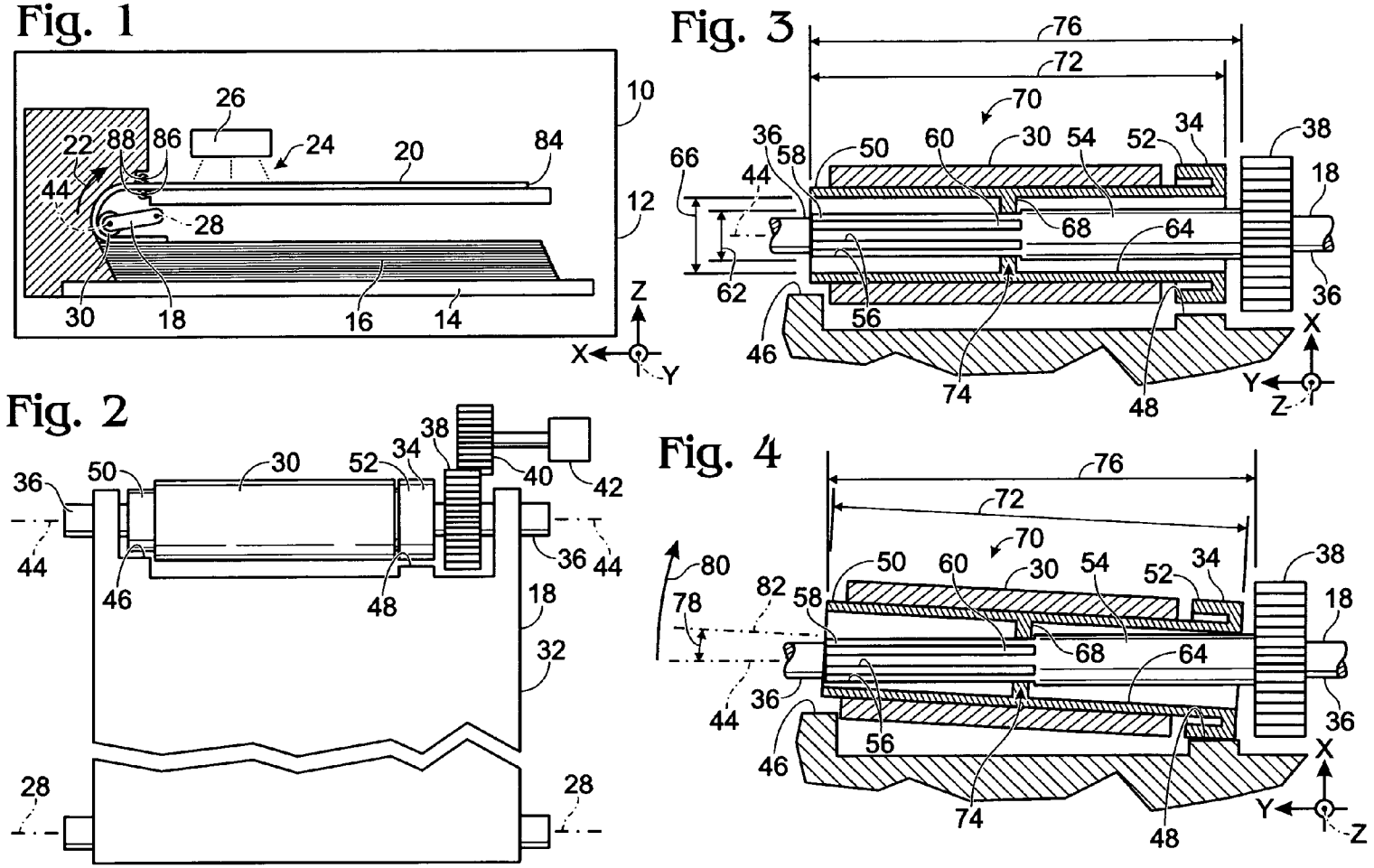
FIG. 1 is cutaway side view of one example embodiment of an imaging device.
FIG. 2 is a top view of one example embodiment of a pick device of the imaging device of FIG. 1.
FIG. 3 is a cross-sectional view of one example embodiment of a pick device in an unpivoted condition.
FIG. 4 is a cross-sectional view of one example embodiment of a pick device in a pivoted condition.

FIG. 1 is cutaway side view of one example embodiment of an imaging device 10. Imaging device 10 may be a printer, for example, and may include a housing 12 that encloses a media support tray 14 and a stack of media 16, such as a stack of paper sheets, for example, supported thereon. A pick device 18 may be positioned above media support tray 14 and stack of media 16 for picking a top sheet 20 of print media from stack of media 16. Pick device 18 preferably picks just top sheet 20, and not sheets positioned below top sheet 20, and moves the top sheet 20 in a direction 22 and into printzone 24 for printing thereon by a printhead 26. Pick device 18 may be pivotally mounted on housing 12 along a pivot axis 28 and may include a pick tire 30 that contacts top sheet 20.

FIG. 2 is a top view of one example embodiment of pick device 18 including a pick body 32 that defines pivot axis 28. Pick tire 30 is mounted on a hub 34 that is mounted on a pick shaft 36, rotatably mounted on pick body 32. Pick tire 30 may be manufactured of a high friction material such as a foam, rubber, or the like, for gripping top sheet 20 (FIG. 1) from stack of media 16 (FIG. 1). Hub 34 and shaft 36 may each be manufactured of a rigid, durable material, such as plastic, metal or the like. Pick shaft 36 may include a toothed gear 38 that may mate with a gear 40, or with a geartrain (not shown), of a motor 42 for powering rotation of pick shaft 36 about its rotational axis 44. Pick shaft 36 is coupled to hub 34, as will be described below with reference to FIG. 3, such that rotation of pick shaft 36 by motor 42 will impart simultaneous rotational movement to hub 34 and pick tire 30 secured thereon. Pick body 32 includes first and second stop surfaces 46 and 48, aligned with end regions 50 and 52, respectively, of hub 34, so as to limit pivoting movement of hub 34 with respect to shaft 36 in a predetermined direction, as will be described below with reference to FIG. 4.

FIG. 3 is a cross-sectional view of one example embodiment of pick device 18 in an unpivoted condition, i.e., hub 34 is not pivoted with respect to pick shaft 36. Pick shaft 36 includes an elongate, cylindrical central region 54 centered around rotational axis 44 and including a plurality of elongate grooves 56 extending from a first end region 58 and past a midregion 60. Grooves 56 may be defined as a coupling device of cylindrical central region 54. Cylindrical central region 54 defines an outside diameter 62.

Hub 34 includes a hollow, cylindrical inner cavity 64 that defines an inner diameter 66 that is larger than outside diameter 62 of central region 54 of pick shaft 36. Hub 34 further includes a plurality of protrusions 68 each extending radially inwardly from the surface of hollow, cylindrical inner cavity 64, wherein, in the embodiment shown, each of protrusions 68 is received within a groove 56 of pick shaft 36. Protrusions 68 may be defined as a coupling device of hub 34 that mates with the coupling device, i.e., grooves 56, of cylindrical central region 54 of pick shaft 36. Accordingly, due to the mating engagement of the coupling devices of pick shaft 36 and hub 34, rotational movement of pick shaft 36 about rotational axis 44 will result in simultaneous rotational movement of hub 34 about rotational axis 44.

FIG. 4 is a cross-sectional view of one example embodiment of pick device 18 in a pivoted condition i.e., hub 34 is pivoted with respect to pick shaft 36. Protrusions 68, in the embodiment shown, are positioned in a central region 70, as measured along a length 72, of hub 34. Accordingly, protrusions 68 may define a pivot region 74 (also referred to as a fulcrum or a gimbaled region) of hub 34 on pick shaft 36 such that hub 34 may pivot or move on pick shaft 36 about protrusions 68, as hub 34 and pick shaft 36 rotate about axis 44. Such pivoting movement (also referred to as gimbaled or tilting movement) of hub 34 on pick shaft 36 is facilitated by inner cavity 64 of hub 34 having an inner diameter 66 (FIG. 3) that is larger than outside diameter 62 (FIG. 3) of central region 54 of pick shaft 36. In the embodiment shown hub 34 may define a length 72 of 22.54 mm and an inner diameter 66 of 6.47 mm, and pick shaft 36 may define a length 76 of central region 54 of 23.19 mm and an outside diameter 62 of 5.43 mm, such that hub 34 may move with respect to central region 54 of pick shaft 36 through an angle 78 of at least plus or minus two degrees, i.e., a range of movement of four degrees centered on rotational axis 44. In other embodiments, other dimensions may allow other ranges of movement as may be desired for a particular application. Moreover, in other embodiments, the coupling devices of pick shaft 36 and hub 34 may include protrusions on the pick shaft and grooves on the hub, or other such coupling structure that allow the hub to pivot on the pick shaft.

Such pivoting movement of hub 34 on pick shaft 36 may be desirable in certain directions as pick tire 30 on hub 34 contacts top sheet 20 (FIG. 1) of stack of print media 16 (FIG. 1), i.e., such as pivoting movement in the x-z plane or in the y-z plane. However, pivoting of tilting movement of hub 34 on pick shaft 36 may be undesirable in certain directions, such as in the x-y plane, which may result in skewing, i.e., twisting of top sheet 20 with respect to an edge of the media support tray 14 (FIG. 1), as the top sheet 20 is picked from stack of print media 16 (FIG. 1). In order to limit the pivoting movement of hub 34 on pick shaft 36 about pivot region 74 in one or more predetermined directions, pick device 18 includes stop surfaces 46 and 48, for example. As shown in FIG. 4, hub 34 is shown pivoting on pick shaft 36 about pivot region 74 through an angle 78, which may be shown exaggerated for ease of illustration. The extent of angle 78 may define an outer limit of an acceptable range of pivoting movement of hub 34 on pick shaft 36 such that stop surface 48 is positioned adjacent to and will contact second end region 52 of hub 34 as hub 34 pivots to this outer limit of the acceptable range of pivoting movement. In other words, once end region 52 of hub 34 contacts stop surface 48, the stop surface 48 hinders or prevents further pivoting movement of hub 34 in a direction 80, such as in the x-y plane. In the embodiment shown, stop surface 48 allows hub 34 to pivot in direction 80 through an angle 78 of approximately two degrees from rotational axis 44. Similarly, stop surface 46 allows hub 34 to pivot in a direction opposite direction 80 through an angle of approximately two degrees from rotational axis 44. In other embodiments, stop surface 48 may be positioned closer to hub 34 such that the stop surface 48 does not allow any pivoting movement in direction 80, which may define a pivoting movement in the x-y plane, for example. In still other embodiments, stop surfaces 46 and/or 48 may be positioned on other portions of pick device 18 to hinder or prevent pivoting movement in other directions or planes, as may be desired for a particular application.

Accordingly, the pivoting hub design of the present invention may provide pivoting movement of hub 34 through an acceptable range of angles which may allow pick tire 30 on hub 34 to orient itself and seat itself flat against top sheet 20 of print media, rather than the orientation of hub 34 being defined by pick shaft 36, as the pick tire 30 is rotated with hub 34 on pick shaft 36. In other words, contact of pick tire 30 with top sheet 20 will position an elongate axis 82 of pick tire 30 and hub 34 parallel to the x-y plane, i.e., parallel to the plane of top sheet 20 on stack of media 16 (FIG. 1), so as to increase the effective coefficient of friction of pick tire 30 on top sheet 20 when compared to prior art pick tires that have their orientation determined by shaft 36, which may be slightly angled with respect to top sheet 20.

Such flat placement of pick tire 30 on top sheet 20 may increase the footprint of pick tire 30 on top sheet 20 and, therefore, may provide an increase in the effective coefficient of friction of pick tire 30 on top sheet 20. Such an increase in the effective coefficient of friction of pick tire 30 on top sheet 20 may increase the pick force that pick tire 30 may deliver, or may allow a reduction in the driving force that may be utilized to pick top sheet 20, i.e., may reduce the amount or normal force utilized to force pick tire 30 onto top sheet 20, which may in turn allow for a smaller motor 42 or for a smaller power draw of motor 42. Moreover, the increased friction of pick tire 30 on top sheet 20, due to its flat orientation on top sheet 20, may allow a single pick tire 30 to be utilized in the imaging device 10, instead of two or more pick tires. Furthermore, the increased friction of pick tire 30, due to its flat orientation on top sheet 20, may reduce the number of mispicks, i.e., the occurrence of non-picks of a top sheet, may reduce the number of multi-picks, i.e., the occurrence of multiple sheets picked simultaneously, and may also reduce smudging or marking of top sheet 20 due to skidding or slipping of pick tire 30 on top sheet 20.

The flat orientation of pick tire 30 on top sheet 20 may also allow for feeding of top sheet 20 along a feed path in direction 22 such that a leading edge 84 (FIG. 1) of top sheet 20 will be evenly fed to a pair of pinch tires 86 (FIG. 1), allowing the pinch tires 86 to evenly grasp top sheet 20 along its leading edge 84. In particular, upon contact with top sheet 20, hub 34 will pivot on pick shaft 36 and will orient itself flat on top sheet 20 such that elongate axis 82 of hub 34 will be positioned parallel to rotational axes 88 of pinch tires 86 such that top sheet 20 is fed with leading edge 84 (shown in end view in FIG. 1) parallel to rotational axes 88 of pinch tires 86, which may allow even grasping of leading edge 84 by pinch tires 86.

Other variations and modifications of the concepts described herein may be utilized and fall within the scope of the claims below.

We claim:

1. An imaging device, comprising:

a shaft that rotates about a shaft elongate axis, said shaft including a first coupling device formed as part of an outer surface of said shaft; and a media pick device including a surface for picking a sheet of media from a media support, said media pick device including a second coupling device coupled to said first coupling device of said shaft such that said media pick device is rotated by rotation of said shaft around said shaft elongate axis, and wherein said media pick device is adapted for pivotal movement at said second coupling device with respect to said shaft during said rotational movement.

2. The device of claim 1 wherein one of said coupling device and said second coupling device comprises a protrusion and wherein another of said coupling device and said second coupling device comprises a groove that receives said protrusion.

3. The device of claim 1 wherein said media pick device comprises a cylindrical pick tire mounted on a cylindrical pick hub, and wherein said second coupling device is positioned on an interior surface of said pick hub.

4. The device of claim 1 further comprising a stop surface positioned to contact said media pick device at a predetermined angle of pivotal movement of said media pick device so as to limit pivotal movement of said media pick device with respect to said shaft.

5. The device of claim 1 wherein said imaging device includes only a single media pick device that includes only a single cylindrical pick tire.

6. The device of claim 1 wherein said imaging device comprises a pair of pinch tires that each define a rotational axis, and wherein said media pick device defines a rotational axis that is aligned with said rotational axes of said pinch tires upon contact of said media pick device with a sheet of print media held in said imaging device.

7. A method of picking a sheet of print media, comprising:

rotating a shaft about a rotational axis;

rotation of said shaft causing rotational movement of a pick tire pivotally mounted on said shaft;

moving said pick tire into contact with a sheet of print media, wherein said contact of said pick tire with said sheet of print media causes said pick tire to pivot at a pivot surface in direct contact with said shaft so as to position an elongate axis of said pick tire parallel to a plane of said sheet of print media.

8. The method of claim 7 wherein said rotational axis of shaft is not parallel to said plane of said sheet of print media.

9. The method of claim 8 wherein said moving said pick tire is conducted at a time chosen from one of after rotation of said shaft, before rotation of said shaft, and during rotation of said shaft.

10. The method of claim 7 further comprising limiting pivotal movement of said pick tire about said shaft by positioning a stop surface adjacent to a stop receiving surface of said pick tire.

11. The method of claim 10 wherein said stop surface limits pivotal movement of said pick tire in a single direction.

12. The method of claim 10 wherein said shaft and said pick tire are mounted on a movable housing that includes said stop surface, and wherein said moving said pick tire includes moving said movable housing.

13. The method of claim 7 wherein said pick tire includes a first coupling device that couples with a second coupling device formed integral with said shaft wherein coupling of said first and second coupling devices causes said rotational movement of said pick tire on said shaft and allows pivotal movement of said pick tire on said shaft.

* * * * *